US007163064B2

(12) United States Patent
Moncus et al.

(10) Patent No.: US 7,163,064 B2
(45) Date of Patent: Jan. 16, 2007

(54) SURFACE FLOW VALVE AND METHOD

(75) Inventors: James Devin Moncus, Lafayette, LA (US); Bryan Duhon, Church Point, LA (US)

(73) Assignee: Devin International, Inc., Lafayette, LA (US)

( * ) Notice: Subject to any disclaimer, the term of this patent is extended or adjusted under 35 U.S.C. 154(b) by 305 days.

(21) Appl. No.: 10/945,310

(22) Filed: Sep. 20, 2004

(65) Prior Publication Data

US 2006/0060360 A1 Mar. 23, 2006

(51) Int. Cl.
*E21B 34/02* (2006.01)
*E21B 33/068* (2006.01)

(52) U.S. Cl. ..... 166/379; 166/70; 166/90.1; 166/95.1; 166/386

(58) Field of Classification Search ..... 166/90.1, 166/386, 86.1, 379, 95.1, 97.1, 78.1; 175/218
See application file for complete search history.

(56) References Cited

U.S. PATENT DOCUMENTS 3,690,381 A * 9/1972 Slator et al. ..... 166/384
3,830,304 A * 8/1974 Cummins ..... 166/305.1
4,111,261 A * 9/1978 Oliver ..... 166/90.1
4,169,504 A * 10/1979 Scott ..... 166/90.1
5,052,657 A * 10/1991 Winship ..... 251/160
5,246,203 A 9/1993 McKnight et al.
5,857,523 A * 1/1999 Edwards ..... 166/374

* cited by examiner

*Primary Examiner*—David Bagnell
*Assistant Examiner*—David Andrews
(74) *Attorney, Agent, or Firm*—C. Dean Domingue; Robert L. Waddell; Ted M. Anthony

(57) ABSTRACT

A surface flow control system for a well. The system comprises a main housing having a main bore there through, and a first port communicating with the main bore. The system further comprises a first valve positioned within the main bore, and wherein the first valve is placed at a position above said first port; and, a second valve positioned within the main bore of the main housing, and wherein the second valve is placed at a position below the first port. The system may further include a swivel connected to the main housing. A second port communicating with the main bore may also be included. In one embodiment, the first port is connected to a tank for collecting fluids discharged from the well, and the second port is connected to a pump for pumping into the well. A method of controlling well pressure is also disclosed.

22 Claims, 5 Drawing Sheets

SURFACE FLOW VALVE AND METHOD

BACKGROUND OF THE INVENTION

This invention relates to a surface flow head. More specifically, but not by way of limitation, this invention relates to a flow valve and method used on the surface of oil and gas installations such as drilling rigs and production platforms.

In the course of drilling, completing, and producing subterranean reservoirs, operators find it necessary to rig up and run into a well various types of work strings. Examples of work strings include, but not limited to, drill strings, coiled tubing, snubbing pipe, and wireline. As those of ordinary skill in the art will recognize, operators will perform various types of well intervention operations on rigs and platforms. The pressure of subterranean reservoirs may be several thousand pounds per square inch (psi). Operators are always concerned with safety of the crew and the rig. Hence, during any type of operation, operators will employ various types of valves that will control the pressure at the surface.

For instance, the specific operation may be to run coiled tubing into a well on a floating platform. A blow out preventer stack (BOP stack) may be rigged to the well at the surface, and wherein the BOP stack will function to surround the coiled tubing to prevent any escape of pressure from subterranean reservoir via the annulus. A lubricator type of string connects to the BOP stack, and wherein the lubricator allows for the entry of the worksting into the well. Additionally, operators will also place a valve that is made up with the lubricator so that pressure that is within the work string can be contained and controlled.

In the past, valves such as the Texas Iron Works, known in the industry as the TIW valve were used. The TIW valves are essentially ball valves that seal in both directions. Other valves have been developed over the years that are similar to the TIW valve. For instance, there is a valve that has become known as a lower kelly valve, and wherein these valves are shorter, in a single piece, and contain an actuating mechanism that is recessed. The lower kelly valves are commercially available from Hydril Inc. under the name lower kelly valve. Hence, as part of the lubricator may contain a lower kelly valve to control the pressures within the inner portion of the lubricator.

However, these valve systems suffer from several disadvantages. For instance, it is desirable to be able to allow flow from the well, but still be able to keep control of the well. Also, the prior art does not allow for a safe and efficient system to pump into the well. Additionally, these prior art systems do not allow the ability to rotate below the valve, while maintaining the valve stationary when attempting to land a tubing hanger. Also, in cases of rigging up, rigging down or performing some other type of maintenance to the BOP stack, or well intervention string, etc, the operator has the ability to rotate either the top half or the bottom half of the valve assembly, while keeping the opposite half stationary. These needs, and many others, will be met by the following described invention.

SUMMARY OF THE INVENTION

A surface flow control system on a well is disclosed. The system comprises a main housing having a first and second end, and wherein the main housing contains a main bore there through, and a first port communicating with the main bore. The system further comprises a first valve position within the main bore of the main housing, and wherein the first valve is placed at a positioned above the first port, and a second valve positioned within the main bore of the main housing, and wherein the second valve is placed at a position below the first port. The system may further comprise a swivel connected to the second end of the main housing, and wherein the swivel is connected to a well head landing string. The landing string may have a tubing hanger configured to land within a surface well head and/or sub-sea tree.

In one preferred embodiment, the first and second valve is a ball valve, and wherein the first and second ball valve can be manually operated.

In the most preferred embodiment, the swivel comprises: a first sub and a second sub threadedly connected so that a cavity is formed, and wherein a thrust bearing means is provided within the cavity; a joint operatively associated with the first and second sub, and wherein the joint contains a radial shoulder abutting the thrust bearing means to allow rotation of the joint.

A second port communicating with the main bore may be provided in one preferred embodiment, and wherein the second port is in a plane longitudinally opposite the first port. In one embodiment, the first port is connected to a tank for collecting fluids discharged from the well. Additionally, the second port may be connected to pump means for pumping into the well.

A method of controlling well pressure from a well completed to a subterranean reservoir is also disclosed. The method comprises providing a surface control system, with the system comprising: a main housing containing a main bore there through, and a first port communicating with the main bore; a first valve position within the main bore of the main housing, and wherein the first valve is placed at a position above the first port; a second valve position within the main bore of said main housing, and wherein the second valve is placed at a position below the first port; a swivel connected to the second end of the main housing, and wherein the swivel is connected to a well head, such as a sub-sea tree.

The method further comprises connecting main housing to a lubricator, connecting the swivel to a landing string, the landing string having a tubing hanger, and rotating the swivel in order to set the tubing hanger within the well head while maintaining the main housing stationary. The method further includes communicating a pressure from the reservoir via the well. The method may further comprise closing the first valve so that the well pressure is controlled. The operator may also close the second valve.

The method may further comprise rigging up a kill line to the first port, and opening the second valve so that a kill fluid is pumped into the well in order to control the pressure.

In one embodiment, the control system contains a second port communicating with the main port, and wherein the second port is axially aligned with the first port, and the method further comprises opening the second valve and releasing the pressure from the well through the second port to a tank. Next, a kill line is rigged up to the first port. The second valve can be opened and a kill fluid is pumped into the well in order to control the pressure.

An advantage of the present system is that it allows a surface safety flow system in an integral tool design. Another advantage is that the surface flow system will allow the controlled release of excess pressure within the inner portion of a production tubing, drill pipe, or other tubular.

Yet another advantage is that the design allows an operator to pump fluid through the surface flow system in order to control pressure.

Still yet another advantage is that the surface flow system can be used on well intervention operations such as coiled tubing, wireline, snubbing jobs, etc. Another advantage is that the system herein described is also applicable to traditional drilling rigs. Yet another advantage is that the system allows rotation of a landing string while the main housing is remains stationary. After the work is completed with the landing string, the valves are in place above the well, and therefore, the remedial well work, such as coiled tubing or wireline work, can commence in safety—a major advantage over prior art systems.

A feature of the present invention is that the system contains a top and bottom valve. The valves may hydraulically actuated low torque plug valves. In another embodiment, the valves may be manual ball valves. Another feature is that the most preferred embodiment contains a first and second port in communication with the main bore of the housing. Yet another feature is the swivel that allows rotation of a landing string while the main housing remains stationary within the derrick of the well. Alternatively, if the operator desires, the main housing can be rotated, and the landing string below the main housing is held stationary.

DETAILED DESCRIPTION OF THE PREFERRED EMBODIMENTS

Figure 1A:
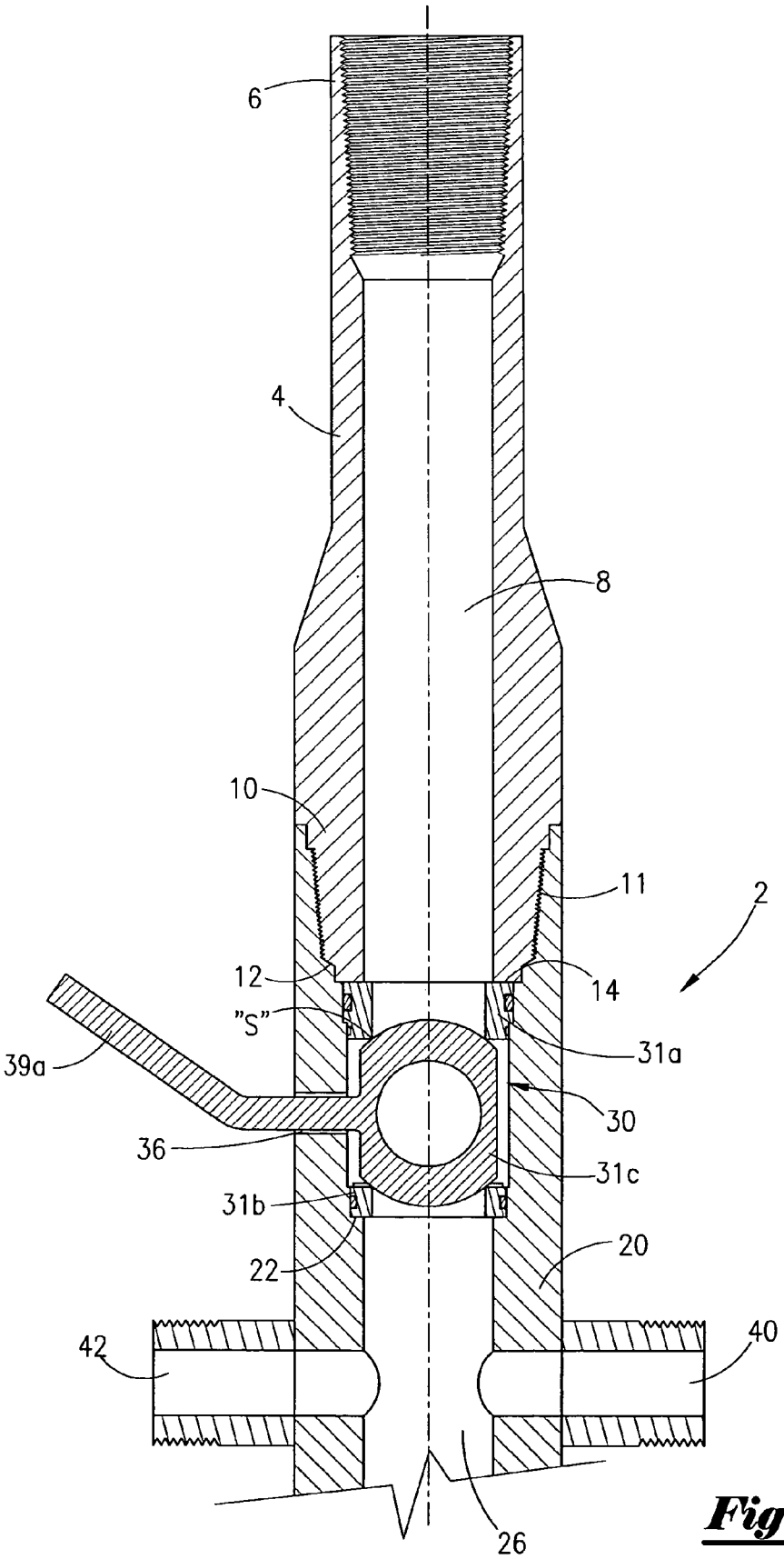
FIGS. 1A and 1B are a partial cross-sectional view of one preferred embodiments of the surface control system.
Figure 1B:
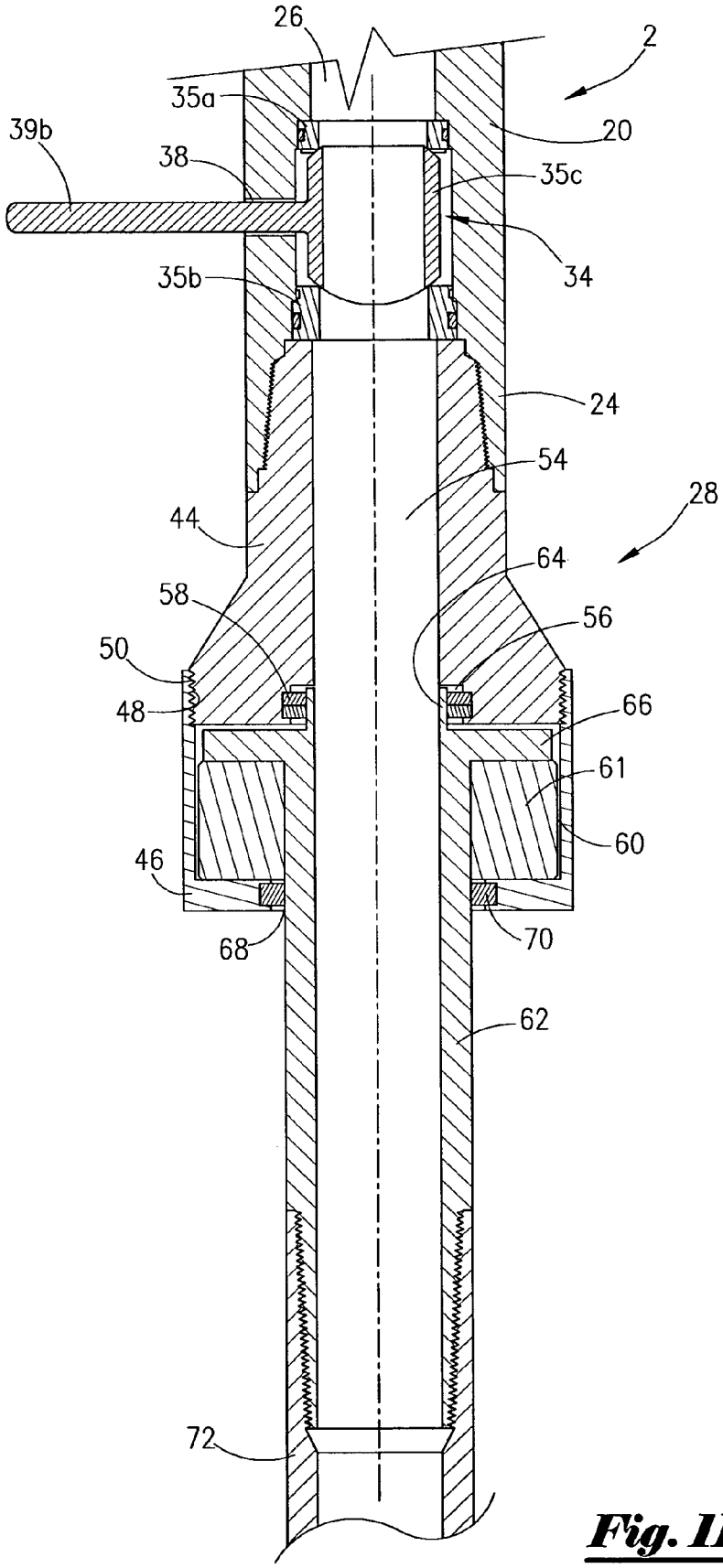

Referring now to FIGS. 1A and 1B, one preferred embodiments of the surface control system 2 is illustrated in a partial cross-sectional view. As seen in FIG. 1A, the surface control system 2 includes a first sub 4 that will contain a first end 6 having a threaded connection. The first end 6 may be connected to a lubricator, as will be discussed later in the application. The first sub 4 has an internal bore 8, as well as the second end 10, and wherein the second end 10 has thread means 11 that extend to a chamfered surface 12, and wherein the surface extends to the radial end 14. As shown, the main housing 20 is threadedly attached to the first sub 4.

The main housing 20 contains an internal shoulder 22 a second end 24, and internal bore 26. As seen in FIG. 1B, the second end 24 of the main housing 20 is connected to the top of the swivel 28. Returning to FIG. 1A, the main housing 20 has positioned therein a first valve 30, and wherein the first valve 30 has an open position and a closed position. The first valve 30 is seated within the internal bore 26. Generally, the first valve 30 comprises a first ball seat 31*a*, a second ball seat 31*b*, and the rotatable ball 31*c*. In one preferred embodiment, the first valve 30 may be a hydraulically actuated valve via control means. In FIG. 1A, the rotatable ball 31*c* is shown in the closed position and wherein the sealing face will be "S". FIGS. 1A and 1B depict the manually actuated valves.

As seen in FIG. 1B, a second valve 34 is also included, and wherein the second valve 34 will also have an opened and closed position, and is manually operated. The valve 34 is shown in the open position. The valve 34 has a first ball seat 35*a*, a second ball seat 35*b*, and the rotatable ball 35*c* so that flow is allowed in both up hole and down hole scenario, and a work string can be raised and lowered in this open position, as readily understood by those of ordinary skill in the art. In the most preferred embodiment, the manually actuated valves 30, 34 are ball type of valves and are commercially available from M & M Supply Inc. under the name Ball Valve.

As seen in FIG. 1A, the main housing 20 contains the opening 36 for access to the first valve 30, and in particular the rotatable ball 31*c*. As seen in FIG. 1B, the main housing 20 contains the opening 38 for access to the second valve 34, and in particular the rotatable ball 35*c*. The handle 39*a* connects to ball 31*c* via opening 36 for rotatably opening and closing; the handle 39*b* connects to ball 35*c* via opening 38 for rotatably opening and closing.

As illustrated in FIG. 1A, the main housing 20 further comprises a first communication port 40 and a second communication port 42. As shown, the ports 40, 42 communicate with the internal bore 26. In the most preferred embodiment, port 40 will be communicated with a tank so that pressurized fluids and/or gas from the well can be unloaded, and the port 42 will be communicated with a pump means for pumping a fluid, such as a kill fluid, to control the pressure from the well. These features will be described in greater detail later in the application.

Returning to FIG. 1B, the swivel 28 will comprise a top member 44 that will be threadedly connected to a bottom member 46. The top member 44 threadedly connects with the second end 24 of the main housing 20. The bottom member 46 contains internal threads 48 that will threadedly connect with the external threads 50 of the top member 44. The top member 44 has an internal bore 54 that extends to an expanded bore 56. As seen in FIG. 1B, within the expanded bore 56 will be placed seal means 58. The top member 44 and the bottom member 46 cooperate to form a cavity, seen generally at 60. Thrust bearings 61 will be included within the cavity 60 for rotation, with the thrust bearings being commercially available from Timken Bearing Co. under the name Thrust Bearings.

The swivel 28 further comprises a joint 62, and wherein the joint 62 has a first end 64 that will cooperate with the seal means 58 to form a seal. The joint 62 further includes a radial shoulder 66, and wherein the radial shoulder 66 is disposed within the cavity 60 and rest on the thrust bearings 61. The joint 62 extends out from the bottom member 46 through the opening 68 of the bottom member 46. As seen in FIG. 1, the opening 68 contains seal means 70, and wherein the seal means 70 will engage the outer portion of the joint 62 thereby providing a seal. The joint 62 will then be threadedly connected to a tubular member 72, and wherein the tubular member 72 may be a well intervention string. In one preferred embodiment, the well intervention string maybe a landing string, and wherein the landing string will have attached thereto a tubing hanger for a surface well head or for a sub-sea tree, as will be explained more fully later in the application. It should be noted that as used in this application, a well head refers to both a surface well head and a sub-sea tree.

Figure 2:
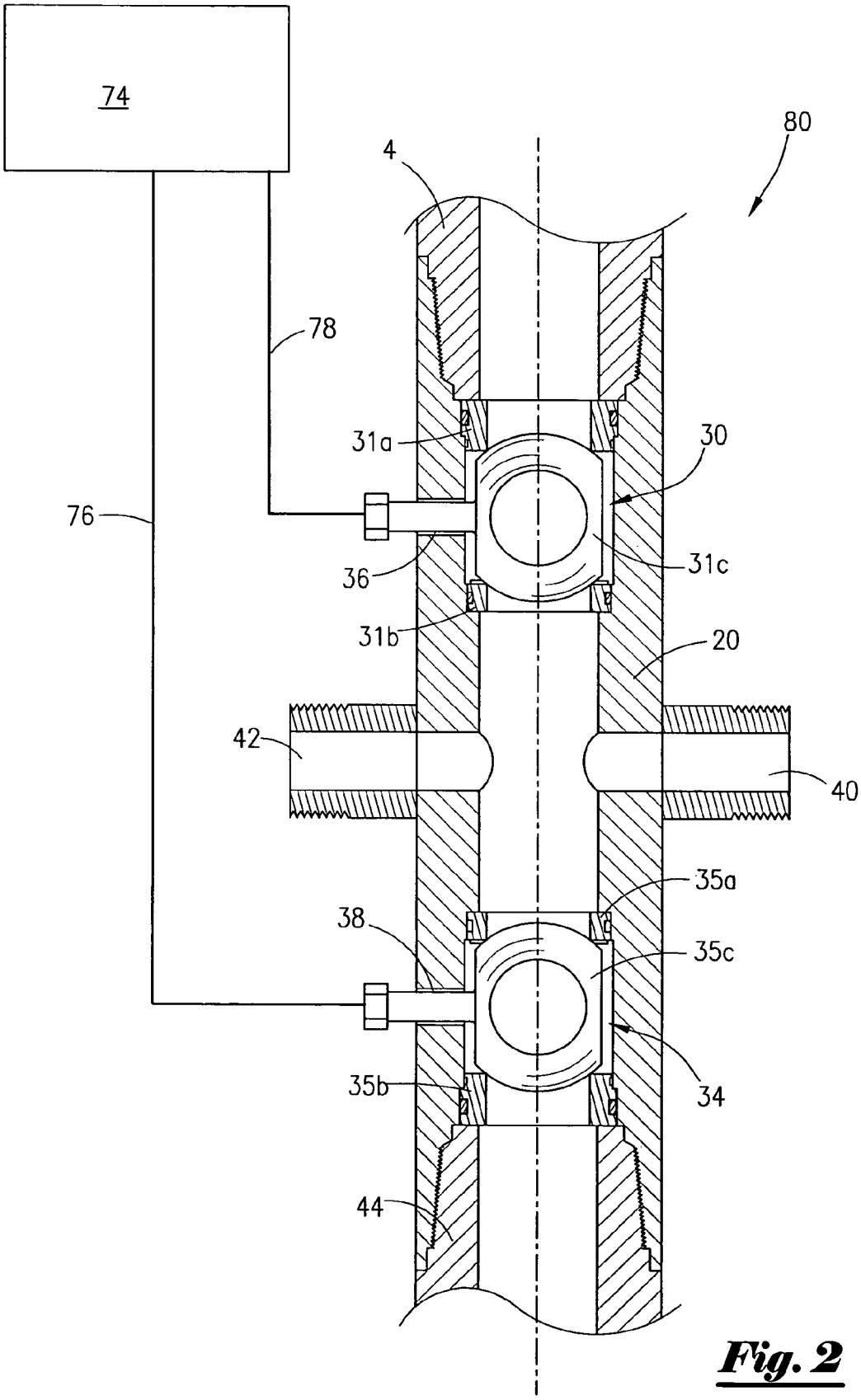
FIG. 2 is a partial cross-sectional view of the second preferred embodiment of the surface control system.

Referring now to FIG. 2, a second preferred embodiment of the surface control system 80 is shown in a partial cross-sectional view. It should be noted that like numbers in the various figures refer to like components. In this second preferred embodiment, the valves 30, 34 are hydraulically actuated ball valves and access can be obtained via the openings 36, 38. With the hydraulically actuated ball valves, there is included hydraulic control means 74 for supplying hydraulic fluid to the hydraulic valves. As understood by those of ordinary skill in the art, the hydraulic lines 76, 78 connect to the valves 30, 34, respectively, in order to provide the power required to open and/or close the valves 30, 34. The valves are held open by hydraulic pressure; therefore, in order to close, the hydraulic supply is cut-off. Additionally, it is possible to have a cannister type of valve as disclosed in U.S. Pat. No. 5,246,203 entitled "Oilfield Valve" and incorporated herein by reference.

Figure 3:
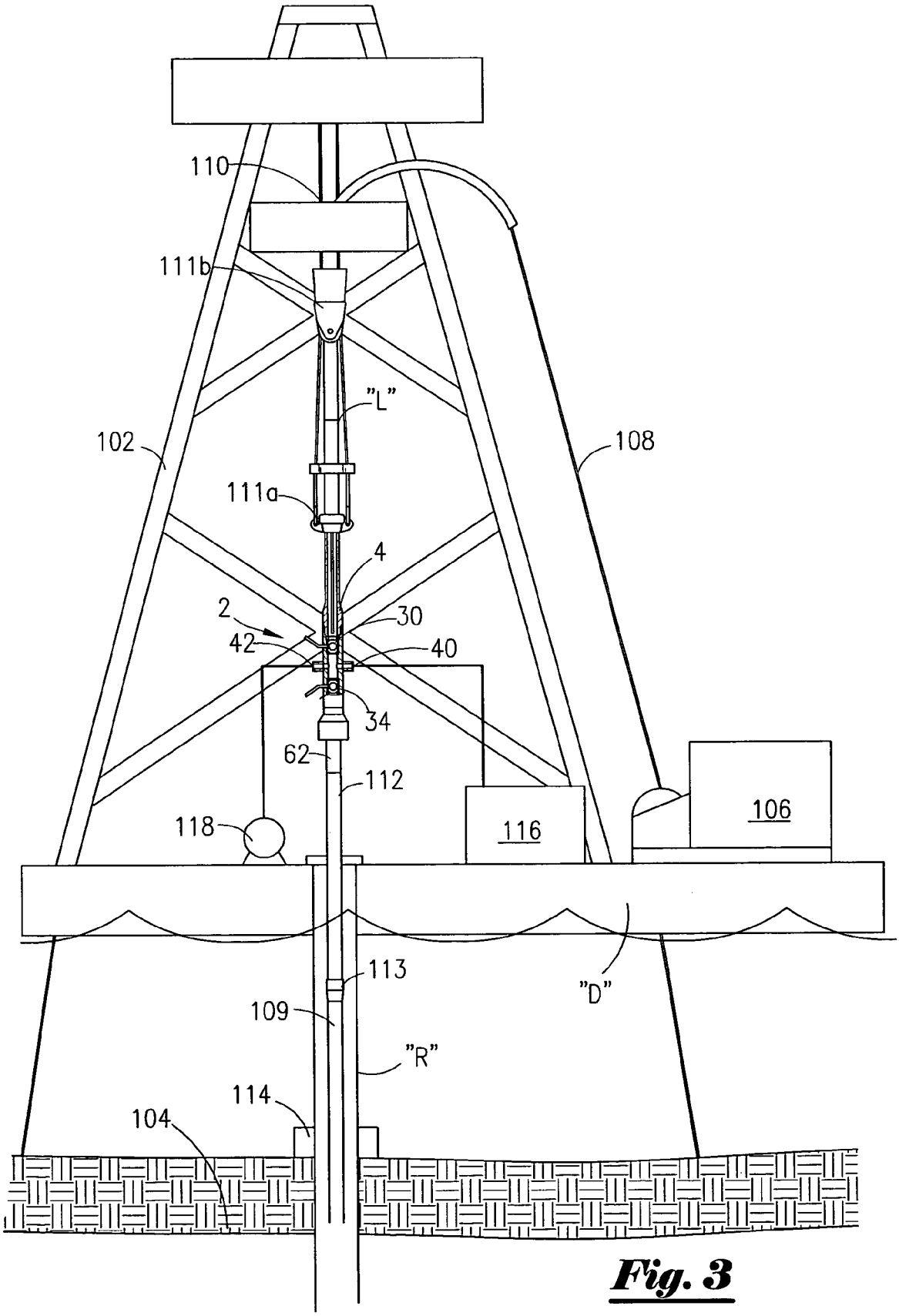
FIG. 3 is a schematic of the one preferred embodiments of the surface control system rigged up to a well on a rig.

Referring now to FIG. 3, a schematic of the preferred embodiment of the surface control system 2 operatively rigged up to a well on a floating rig 102 will now be described. The well is completed to a subterranean reservoir 104, and wherein the reservoir 104 is under pressure and the pressure is communicated to the well. The schematic of FIG. 3 shows that a coiled tubing unit 106 is rigged up on the floating rig 102, and wherein the coiled tubing 108 can be run into the well through the surface control system 2. A tubular string 109 is shown within the well and wherein the coiled tubing 108 may be concentrically disposed within the tubular string 109, as well understood by those of ordinary skill in the art. It should be understood that other types of work strings can be employed and run through the surface control system 2 such as snubbing pipe, wireline, electric line, drill pipe, production tubing, etc. As seen in FIG. 3, the coiled tubing 108 has not been lowered within the tubular 109. FIG. 3 depicts the valves 30, 34 in the closed position. Additionally, the sub 4 is attached to a lubricator "L" which in turn is connected to the coiled tubing injector head 110 and wherein the coiled tubing injector head 110 is suspended via elevators 111*a* attached to the block 111*b*.

In the embodiment shown in FIG. 3, the joint 62 is connected to a landing string 112 that in turn has a connected tubing hanger 113 which is designed to land within a well head 114. As understood by those of ordinary skill in the art, when performing well intervention work, an operator will need to first set the tubing hanger within the well head before entering the well. The tubing hanger anchors the tubing 109 in the well. In the embodiment shown, the well head 114 is a sub-sea tree on the sea floor, and a marine riser "R" connects the sub-sea tree 114 the deck "D" of the floating rig 102. It should be noted that it is possible to have the tubing hanger 113 land into a well head located on the surface utilizing a conventional rig.

Once the surface control system 2 is rigged up in the derrick of the rig 102, and due to the novel design, the operator can rotate the landing string 112 in order to perform any type of remedial work and/or land the tubing hanger 113 within the well head 114. Hence, the operator can accomplish this without having to also turn the surface control system 2, elevators 111*a*, block, etc. Additionally, once the tubing hanger 113 has been landed, the remedial well work is ready to commence with the control system 2 in place and operational for well safety control.

FIG. 3 depicts the situation wherein pressure from the reservoir has built up at the surface. Hence, the operator has opted to close the valves 30, 34. If these valves were hydraulically actuated, then the valves would be closed by withdrawing hydraulic pressure. In the most preferred embodiment, the valves are manual, and the valves are rotated closed. The operation would include closing valves 30 and 34. FIG. 3 further illustrates that the first communication port 40 is fluidly connected to a tank 116. The tank 116 can be used to unload fluids and/or gas pressure from the well. The second communication port 42 is fluidly connected to the pump means 118 for pumping into the well. The pump means 118 can be used to pump a fluid, sometimes referred to as a kill fluid, in order to control the pressure within the well. As understood by those of ordinary skill in the art, the hydrostatic head suppresses the reservoir pressure, and hence, the term kill fluid is used. Note that the coiled tubing 108 is positioned above the surface control system 2 in FIG. 3.

Figure 4:
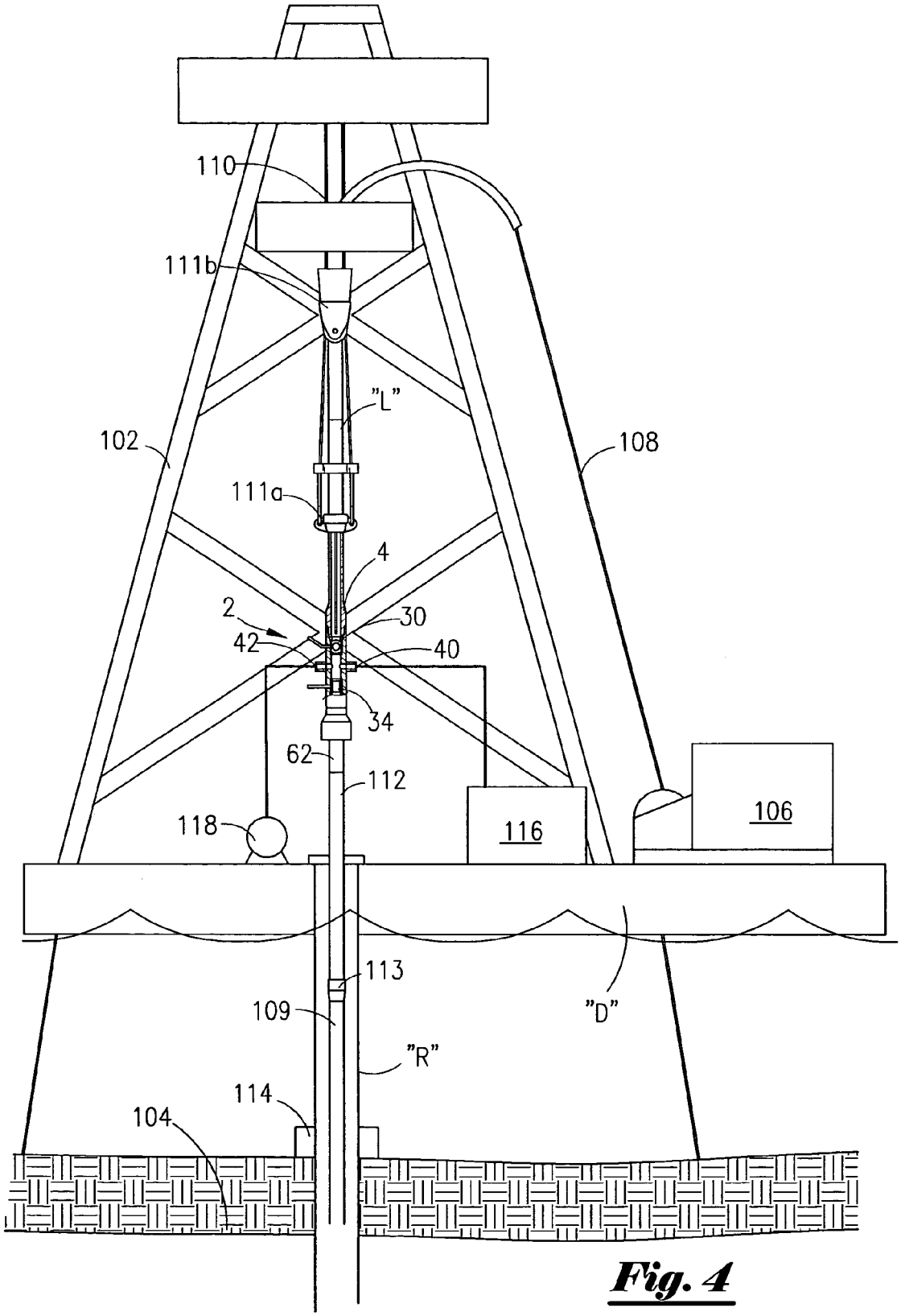
FIG. 4 is the schematic of surface control system seen in FIG. 3 depicting producing and pumping stages.

Referring now to FIG. 4, the producing and pumping stages of the surface control system 2 will now be described. More specifically, the valve 34 has been opened. Hence, in the case where the pressure in the well has built up, the operator can open the valve 34 and release pressure into the tank 116. As readily understood by those of ordinary skill in the art, the operator may also choose to pump into the well via the pump means 118. The operator can pump a fluid, such as a weighted fluid, to control the pressure. The weighted fluid is sometimes referred to as a kill fluid. Once under control by the operator, the valve 30 can be opened. The work string, such as the coiled tubing, can be concentrically lowered through the tubular 109 and operations can continue. Additionally, if the operator finds it necessary to perform any type of routine maintenance, rigging up, rigging down, adjustments, or any other type of work, the operator can utilize the swivel in order to rotate the surface control system 2 relative to the bottom joint 62 and lubricator section "L", which is an advantage of the present invention.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

We claim:

1. A surface flow control system on a well, the well being connected to a well head, the system comprising:

a main housing having a first end and a second end, and wherein said main housing contains a main bore there through, and a first port communicating with the main bore;

a first valve positioned within the main bore of said main housing, and wherein said first valve is placed at a position above said first port;

a second valve positioned within the main bore of said main housing, and wherein said second valve is placed at a position below said first port;

a swivel connected to the second end of the main housing, and wherein said swivel is connected to a landing string having a tubing hanger, and wherein said tubing hanger is configured to land within the well head, the well head being connected to the well.

2. The system of claim 1 wherein said first and second valve is a ball valve.

3. The system of claim 2 wherein said swivel comprises: a first sub and a second sub threadedly connected so that a cavity is formed, and wherein thrust bearing means is provided within the cavity; a joint operatively associated with the first and second sub, said joint having a radial shoulder abutting said thrust bearing means to allow rotation of said joint.

4. The system of claim 3 wherein said first and second ball valve are manually operated.

5. The system of claim 1 wherein said main housing further comprises a second port communicating with the main bore.

6. The system of claim 5 wherein said second port is in a plane longitudinally opposite said first port.

7. The system of claim 6 wherein said first port is connected to a tank for collecting fluids discharged from the well.

8. The system of claim 7 wherein said second port is connected to pump means for pumping into the well.

9. A method of controlling well pressure from a well completed to a subterranean reservoir, and wherein said well is connected to a well head, the method comprising:

providing a surface flow control system, said system comprising: a main housing having a first end and a second end, and wherein said main housing contains a main bore there through, and a first port communicating with the main bore; a first valve position within the main bore of said main housing, and wherein said first valve is placed at a position above said first port; a second valve position within the main bore of said main housing, and wherein said second valve is placed at a position below said first port; a swivel connected to the second end of the main housing, and wherein said swivel is connected to the well head;

connecting a first end of the main housing to a lubricator connecting a second end of the swivel to a landing string, said landing string having a tubing hanger;

rotating the swivel in order to set the tubing hanger within the well head while maintaining the main housing stationary.

10. The method of claim 9 further comprising:

communicating a pressure from the reservoir into the well;

closing the first valve and the second valve so that the well pressure is controlled;

rigging up a kill line to said first port;

opening said second valve;

pumping a kill fluid into the well in order to control the pressure.

11. The method of claim 9 wherein said main housing contains a second port communicating with the main bore, and wherein said second port is axially aligned with said first port, and the method further comprising:

communicating a pressure from the reservoir into the well;

closing the first valve and the second valve so that the well pressure is controlled;

opening said second valve;

releasing the pressure from the well through the second port into a tank;

rigging up a kill line to said first port;

pumping a kill fluid through said first port into the well in order to control the pressure.

12. A surface control system for a well having a work string concentrically disposed therein, the system comprising:

a main housing having a first end and a second end, and wherein said main housing contains an axial bore there through, and a first port communicating with the axial bore and a second port communicating with the axial bore, and wherein said first end is connected to a lubricator that has the work string disposed there though;

a first valve positioned within the axial bore of said main housing, and wherein said first valve is placed at a position above said first port;

a second valve positioned within the main bore of said main housing, and wherein said second valve is placed at a position below said first port;

a swivel connected at a first end to the second end of the main housing, and wherein said swivel is connected at a second end to a landing string, and wherein said swivel allows rotation of the landing string relative to said main housing.

13. The system of claim 12 wherein said swivel comprises: a first sub and a second sub threadedly connected so that a cavity is formed, and wherein thrust bearing means is provided within the cavity; a joint operatively disposed within the first and second sub, said joint having a radial shoulder abutting said thrust bearing means to allow rotation of said joint, and wherein said joint is connected to said landing string.

14. The system of claim 13 wherein said first and second valve is a ball valve.

15. The system of claim 14 wherein said first and second ball valve are manually operated.

16. The system of claim 15 wherein said second port is in a plane longitudinally opposite said first port.

17. The system of claim 15 wherein said first port is connected to a tank for collecting fluids discharged from the well.

18. The system of claim 15 wherein said second port is connected to pump means for pumping into the well.

19. The system of claim 15 wherein the work string is a coiled tubing string.

20. The system of claim 15 wherein the work sting is a wireline.

21. The system of claim 14 wherein said first and second valves are hydraulically operated.

22. The system of claim 14 wherein said landing string contains a tubing hanger that can be landed within a well head.

* * * * *